United States Patent [19]

Nidy

[11] 4,221,385

[45] Sep. 9, 1980

[54] SHUFFLEBOARD GAME APPARATUS

[76] Inventor: Robert K. Nidy, P.O. Box 1372, Winter Park, Fla. 32790

[21] Appl. No.: 921,209

[22] Filed: Jul. 3, 1978

[51] Int. Cl.[3] ..... A63F 3/00

[52] U.S. Cl. ..... 273/126 R; 273/127 D; 273/385; 273/102.1 F

[58] Field of Search ..... 273/127 R, 127 D, 126 R, 273/1 M, 41, 102 AP, 102 S, 102.1 C, 102.1 E, 102.1 F; 278/118 R, 143 R

[56] References Cited

U.S. PATENT DOCUMENTS

| | | | |
|---|---|---|---|
| 240,334 | 4/1881 | Pittman | 273/127 R |
| 612,198 | 10/1898 | Ehmer | 273/126 R |
| 797,244 | 8/1905 | Walk | 273/41 |

FOREIGN PATENT DOCUMENTS

| | | | |
|---|---|---|---|
| 20733 | 10/1898 | United Kingdom | 273/127 R |

*Primary Examiner*—Richard C. Pinkham
*Assistant Examiner*—T. Brown
*Attorney, Agent, or Firm*—Duckworth, Hobby, Allen & Pettis

[57] ABSTRACT

Game apparatus physically adapted for use on a flat playing surface, such as a shuffleboard court includes a support frame having a bracket for engaging the parallel edges of the shuffleboard court and a horizontal support bar suspended above the court between the two edges thereof. A plurality of scoring pins is each pivotally mounted underneath the horizontal bars so as to be suspended between the bar and the surface of the shuffleboard court. Each scoring pin has a flexible brush mounted on its lower extremity and extending downwards so as to engage the playing surface. Plural score indicating plates are provided, each plate being rotatably coupled to the horizontal bar, and positioned adjacent to one of the scoring pins with a corresponding score thereon. A latch couples the scoring plate in a lowered, horizontal position until such time as the shuffleboard disc drives the corresponding scoring pin in an arc about the support bar, thereby overcoming the latch to permit the corresponding score plate to rotate to the vertical position to indicate the score of the pin struck by the shuffleboard disc.

16 Claims, 5 Drawing Figures

FIG. 1
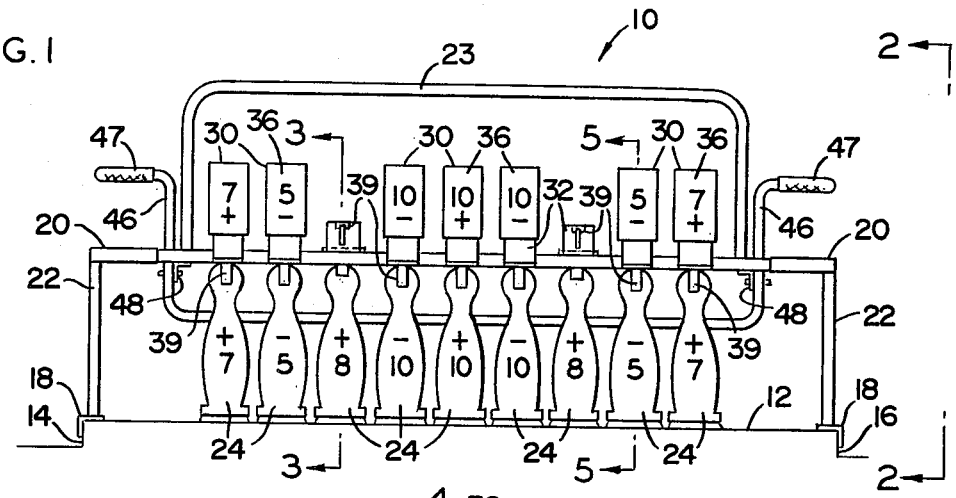
FIG. 2
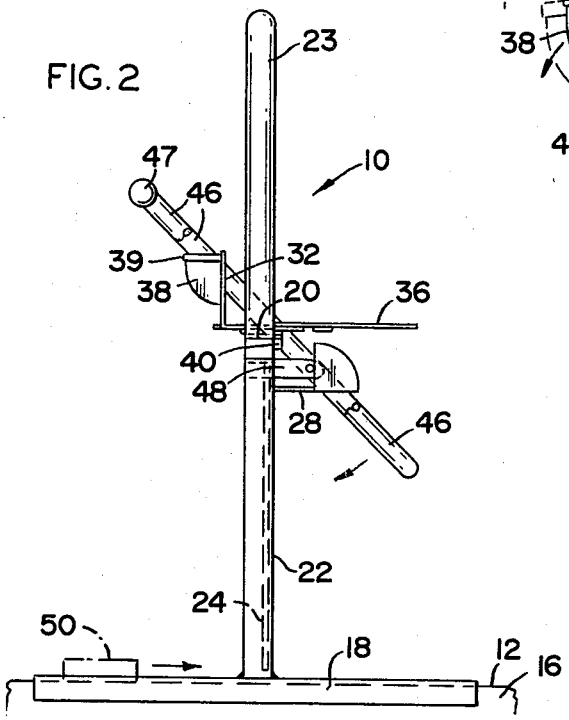
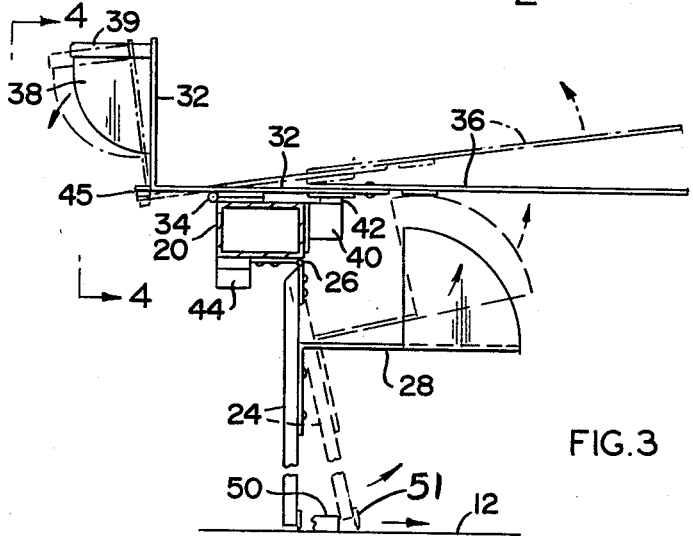
FIG. 3
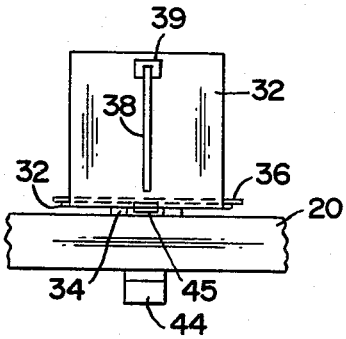
FIG. 4
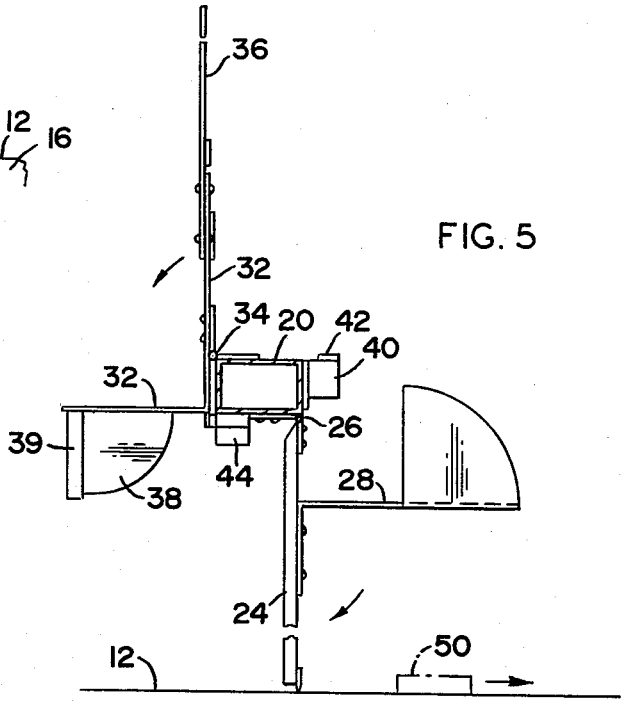
FIG. 5

SHUFFLEBOARD GAME APPARATUS

BACKGROUND OF THE INVENTION

1. Field of the Invention

The present invention relates generally to game apparatus, and in particular relates to arrangements which are designed to be utilized in conjunction with conventional shuffleboard equipment to play another game separate and apart from the conventional shuffleboard game.

2. Description of the Prior Art

Shuffleboard is a well known outdoor game conventionally played on a court defined by a generally rectangular, raised flat surface which is relatively long and narrow. The game is played by sliding flat discs along the surface, and permitting the discs to stop within scoring areas at the opposite end of the court.

There are a number of outdoor game arrangements which have been taught in the prior art for use on a flat playing surface. Typical of these prior art arrangements is that shown in U.S. Pat. No. 3,430,959 to Ross and Wolverton. In the arrangement taught by Ross, et al., magnetic elements are used in conjunction with the magnetic reeds to indicate the passage of a game projectile past the target.

In U.S. Pat. No. 3,690,664 Huake discloses a "tic tac toe" game arrangement designed to be played on a flat surface, such as the ground. As there disclosed, the arrangement includes plural scoring plates which are rotatably coupled to a horizontal support bar.

Other prior art of interest is disclosed in the following U.S. Pat. Nos. 3,227,448; 196,982 to Lyman; and 650,948 to Nelson.

SUMMARY OF THE INVENTION

The present invention contemplates game apparatus for playing a game adjacent a flat supporting surface, and comprises a support member with means for holding the support member in spaced relation to the supporting surface. The apparatus is provided with plural target members, with each target being independently and rotatably coupled to the support member whereby an object moving along the supporting surface causes at least one of the target members to be pivoted with respect to the support member. The apparatus further includes plural scoring indicia, each scoring indicia being independently and rotatably coupled to the support member adjacent a corresponding one of the target members. Plural latch means are provided, each coupled with a corresponding one of the scoring indicia to inhibit rotation about the support member. Each target member includes means for overcoming the latch to effect the rotation of the adjacent one of the scoring indicia response to rotation of the corresponding target member.

In the preferred embodiment of the present invention, the apparatus is specifically adapted for use on a conventional shuffleboard court of the type characterized by a raised, hard playing surface defined by spaced, parallel edges. In use, the shuffleboard playing disc causes rotation of the target member, which in the preferred embodiment is in the shape of a bowling pin, to thereafter effect movement of the scoring indicia associated therewith.

Further in accord with the preferred embodiment of the present invention, the scoring indicia constitutes a ferrous metal plate, and the latch associated with the adjacent target member comprises a magnet which holds the scoring plate in a horizontal position. The latch overcoming means comprises a bracket mounted at the back of the target pin, which bracket is adapted to force the scoring plate upward responsive to rotation of the scoring pin about the support frame. This movement of the scoring plate overcomes the attraction of the associated magnet. The scoring plate is further provided with a counterweight at the forward end which thereafter causes the plate to be rotated about the support frame into a vertical position. Both the scoring plate and the associated scoring pin are provided with like printed scores thereon, in order that accumulative score may be arrived at as the game is being played.

In accordance with the preferred embodiment of the invention, the support frame for the game apparatus includes a pair of spaced, angled brackets which are adapted to snugly fit the opposing top edges of the shuffleboard court at one end thereof. Each scoring pin has a brush strip along the bottom, to inhibit inadvertant movement caused by the wind.

THE DRAWING

FIG. 1 is a front elevation of a preferred embodiment of game apparatus in accordance with the present invention.

FIG. 2 is a side elevation of the apparatus shown in FIG. 1, as viewed along the line 2—2.

FIG. 3 is a cross sectional elevation of the apparatus shown in FIG. 1, taken along the line 3—3.

FIG. 4 is a front elevation of a portion of the apparatus shown in FIG. 3, taken along the line 4—4.

FIG. 5 is a cross sectional elevation of a portion of the apparatus as shown in FIG. 1, and taken along the line 5—5.

DESCRIPTION OF THE PREFERRED EMBODIMENT

The preferred embodiment of the present invention will now be described with reference to the drawing.

The game apparatus of the present invention is referred to generally by the reference numeral 10 in FIG. 1. The apparatus 10 is adapted for use with a conventional shuffleboard court 12 defined by a raised flat surface between the opposing edge surfaces 14, 16.

The game apparatus 10 includes a supporting structure defined by a pair of angle brackets 18 engaging the opposing edges 14, 16 of the shuffleboard court 12. The supporting structure further includes a horizontal support bar 20 supported by opposing side posts 22, each of which are affixed to an associated one of the brackets 18. As thus shown in FIG. 1, it will be understood that the apparatus 10 is suspended above a conventional shuffleboard court 12 (preferably at one end thereof) and perpendicular to the normal direction of play. The supporting structure further includes a carrying bar 23 which is coupled to the support bar 20 to permit the apparatus to be carried in a conventional manner.

In accordance with the present invention, the apparatus 10 is provided with a plurality of target members 24. With reference to FIGS. 1, 3 and 5, each target member 24 is rotatably coupled to the support bar 20 at the top of each target member by a hinge 26 having at least 180° of travel. As shown, each target member 24 is suspended between the support bar 20 and the playing surface of the shuffleboard court 12, with a slight space therebetween. The target member 24 may be formed of a nonferrous material, such as aluminum, or wood. A bracket 28 is mounted on the back side of each target member 24, the extremity of each bracket being formed of a curved aluminum blade which is adapted such that the extremity does not extend above the level of the support bar 20 when the associated target member 24 is in the vertical position.

Noting FIG. 1, the apparatus 10 is provided with plural scoring indicators 30. With reference now to FIGS. 3, 4 and 5, each scoring indicator 30 is comprised of an L-shaped bracket 32 coupled to the top of the bar 20 by a hinge 34 which is capable of at least 90° travel. Each scoring indicator 30 further includes a score plate 36 riveted or otherwise fastened to an extremity of the bracket 32 in the manner shown in FIGS. 1, 3 and 5. A curved return blade 38 is fixed to the front side of the bracket 32, and a counterweight 39 is mounted on the extreme edge of the blade 38. As shown in FIG. 3 and as was referred to above, each of the brackets 28 mounted to a corresponding target member 24 has a slight spacing between the extremity thereof and corresponding score plate 36 when the target member 23 is in the vertical position.

Referring again to FIG. 1, it will be seen that each target member 24 is in the shape of a scoring pin, much like a bowling pin. Each target member 24 has a preselected score imprinted thereon. Likewise, the corresponding one of the scoring plates 36 associated with the adjacent target member 24 has a preselected score imprinted thereon which is identical to the score contained on the adjacent target member.

Reference is again made to FIGS. 3 and 5. The apparatus 10 further includes means for latching the scoring plate 36 in place until the adjacent target member 24 is rotated from the vertical position to cause the bracket 28 to overcome that latch means. In this example, the latch comprises a plurality of magnets 40, each magnet being positioned with one of the combinations of target members 24 and scoring plates 36 alongside the support bar 20. Suitably, the latch includes a nonmetallic standoff 42 mounted between the plate 32 and the magnet 40. As thus described, it will be understood that the magnet 40 holds the ferrous bracket 32 (and the associated scoring plate 36) in the horizontal position until such time as the bracket 28 is rotated sufficiently to cause the plate 36 to be rotated away from the magnet 30. In this way, the latching effect of the magnet 40 is overcome, thus permitting the counterweight 39 to rotate the bracket 32 and the associated score plate 36 about the hinge 34, raising the score plate 36 to a vertical position (Note FIG. 1). While not essential to the proper function of the present invention, the apparatus 10 may further include a second magnet 44 mounted along the bottom of the support bar 20 at the front edge thereof, to secure the scoring indicator 30 in place. The bracket 32 may include a non-metallic standoff 45 at the extremity thereof.

Referring now to FIGS. 1 and 2, the apparatus 10 may further include a release bar 46 in the form of a U-shaped bracket, mounted on hinges with release pins 48 at the support bar 20, and weighted handles 47. This release bar 46 is adapted to be rotated in the direction of the arrow shown in FIG. 2. Each target 24 may include a vinyl brush strip 51 for preventing movement of the target by the wind.

Utilization of the apparatus 10 for playing a game on a conventional shuffleboard court will now be described.

Referring to FIG. 1, the game is begun by fixing the apparatus 10 on the shuffleboard court 12 as shown, with the brackets 18 firmly engaging the opposing side edges 14 and 16 of the shuffleboard court 12. All of the scoring plates 36 are rotated to the horizontal position, such that the associated bracket 32 is latched in that position by the associated magnet 40.

Reference is now made to FIGS. 2, 3 and 5. A player at the opposite end of the shuffleboard court causes a conventional shuffleboard disc 50 to be moved along the shuffleboard court surface in the direction of the target members 24. Noting FIG. 3, the movement of the shuffleboard disc 50 past one of the target members 24 causes that member to rotate away from the vertical position, thereby causing the bracket 28 to engage the associated scoring plate 36. This movement overcomes the latching effect of the magnet 40, releasing the scoring indicator including the associated bracket 32 and the scoring plate 36. The counterbalance 39 then forces the scoring indicator arrangement to the vertical position, as shown in FIG. 5. In this way, the players at the opposite end of the court may determine the score of the target member which has been struck, since the same score is imprinted on the target member as is imprinted on the associated scoring plate 36.

After all of the shuffleboard discs 50 have been played by one or more players, the release bar 46 may then be rotated about the associated pins 48 in the direction of the arrow shown in FIG. 2. This causes all of the target members 24 to be rotated in a forward direction, and out of the vertical position. The weighted handles 47 keep the release bar 46 in the rotated position. Thereafter, a player at the end of the shuffleboard court 12 where the game apparatus 10 is located, may return the shuffleboard discs to the players at the opposite end by sliding the discs along the court 12 and underneath the game apparatus 10, the target members 24 having been rotated out of position so as to prevent interference with the returning of the discs to the players. At the time the release bar 46 is rotated, the front side of each target member 24 is pushed back to its original position. Subsequently, the player at the end of the court where the game apparatus is located may manually rotate all of the scoring plates 36 to the horizontal position to permit another play.

I claim:

1. Apparatus for playing a game adjacent a flat supporting surface, comprising:

a support member;

means for holding said support member in spaced relation to said supporting surface;

plural target members, each target member being independently and rotatably coupled to said support member, whereby an object moving along said supporting surface causes at least one of said target members to be pivoted with respect to said support member;

plural scoring indicia, each scoring indicia being independently and rotatably coupled to said support member adjacent a corresponding one of said target members;

plural latch means, each latch means coupled with a corresponding one of said scoring indicia to inhibit rotation thereof;

means with each target member for overcoming said latch means to effect rotation of the adjacent one of said scoring indicia responsive to rotation of the corresponding target member; and a flexible brush mounted on the extremity of each target member and in engagement with said surface.

2. The game apparatus recited in claim 1 wherein said support member comprises a horizontal bar adapted to be suspended transverse to the direction of movement of such object along said surface.

3. The game apparatus recited in claim 2 wherein each said scoring indicia comprises a ferrous metal, and wherein said plural latch means comprises a plurality of magnets carried by said bar.

4. The game apparatus recited in claim 3 wherein said latch overcoming means includes plural brackets, each bracket carried by one of said target members for rotating the corresponding scoring indicia away from the adjacent magnet responsive to rotation of said target member.

5. The game apparatus recited in claim 4 wherein each of said scoring indicia includes a counterweight to continue rotation of said scoring indicia after separation from the corresponding magnet.

6. The game apparatus recited in claim 5 wherein each of said scoring indicia is rotatably coupled to said bar intermediate the ends of said scoring indicia, such that said bar stops complete rotation of each scoring indicia when substantially in the vertical position.

7. The game apparatus recited in claim 6 further comprising means for locking each of said scoring indicia into the vertical position.

8. The game apparatus recited in claim 7 wherein said locking means comprises a second magnet.

9. The game apparatus recited in claim 1 and further comprising a release bar rotatably coupled to said support means for returning each of said score indicia to the latched position.

10. The game apparatus recited in claim 9 further comprising a blade mounted on each scoring indicia and dimension to be contacted by the corresponding target member after rotation by said release bar, thereby rotating said scoring indicia to the latched position.

11. Game apparatus specifically adapted for use on a conventional shuffleboard court of the type characterized by a raised, hard playing surface defined by spaced, parallel edges, said game apparatus comprising:

a support frame having bracket means for engaging said parallel edges, said support frame including a horizontal support bar suspended above said shuffleboard court surface between said two edges;

plural scoring pins, each pin having a score imprinted on a face thereof and being pivoted at one end underneath said horizontal bar so as to be suspended between said bar and said surface;

plural score-indicating plates, each plate being rotatably coupled to said horizontal bar between the extremities thereof, each plate being positioned adjacent one of said scoring pins and having a score imprinted on a face thereof corresponding to the score imprinted on the adjacent scoring pin;

means for latching each scoring pin for decoupling the corresponding plate responsive to rotation of the corresponding scoring pin, to permit said plate to rotate to the vertical position and display the score imprinted thereon; and a flexible brush mounted on the extremity of each target member and in engagement with said surface.

12. The game apparatus recited in claim 11 further comprising means for facilitating further rotation of each plate to the vertical position following decoupling from said latching means.

13. The game apparatus recited in claim 11 further comprising means for simultaneously rotating all of said scoring pins to the horizontal position.

14. The game apparatus recited in claim 13, wherein said simultaneous rotating means includes means for returning each score-indicating plate to engagement with said latching means.

15. The game apparatus recited in claim 11 wherein said decoupling means comprises a bracket member carried by each said scoring pin for rotating the corresponding scoring plate away from the horizontal position.

16. The game apparatus recited in claim 14 wherein a portion of each plate comprises a ferrous metal and wherein said latching means comprises a magnet carried by said bar.

* * * * *